United States Patent [19]

Lewis

[11] 4,434,066

[45] Feb. 28, 1984

[54] WATER-BASED ENERGY TRANSMITTING FLUID COMPOSITIONS

[75] Inventor: Walter E. F. Lewis, Stamford, Conn.

[73] Assignee: Union Carbide Corporation, Danbury, Conn.

[21] Appl. No.: 460,872

[22] Filed: Jan. 25, 1983

Related U.S. Application Data

[63] Continuation-in-part of Ser. No. 221,503, Dec. 30, 1980, abandoned.

[51] Int. Cl.[3] ..... C10M 3/04; C10M 3/14; C10M 3/26

[52] U.S. Cl. ..... 252/77; 252/49.3; 252/49.5; 252/51.5 A; 252/79

[58] Field of Search ..... 252/49.3, 49.5, 51.5 A, 252/77, 79

[56] References Cited

U.S. PATENT DOCUMENTS

| | | | |
|---|---|---|---|
| 2,197,774 | 4/1940 | Whalely et al. | 252/77 X |
| 2,602,780 | 7/1952 | Zisman et al. | 252/73 |
| 3,245,909 | 4/1966 | Lowe | 252/51.5 A |
| 3,346,495 | 10/1967 | Malec et al. | 252/49.3 |
| 3,630,898 | 12/1971 | Tecter et al. | 252/49.3 X |
| 3,826,746 | 7/1974 | Schick et al. | 252/51.5 A X |
| 3,992,312 | 11/1976 | Genjida et al. | 252/49.3 X |
| 4,241,013 | 12/1980 | Hirozawa et al. | 252/77 X |

*Primary Examiner*—John E. Kittle
*Assistant Examiner*—Robert A. Wax
*Attorney, Agent, or Firm*—Jean B. Mauro

[57] ABSTRACT

Aqueous compositions having a viscosity of at least 10 centistokes at 40° C. which contain up to about 80 percent by weight of water, at least 0.1 percent by weight of an acidic lubricity agent and an effective amount of an anti-wear additive which is the combination of a nitroaromatic compound component and a hydroxyl substituted aromatic acid component exhibit enhanced anti-wear and lubricity properties.

20 Claims, No Drawings

WATER-BASED ENERGY TRANSMITTING FLUID COMPOSITIONS

This application is a continuation-in-part of Ser. No. 221,503, filed Dec. 30, 1980, now abandoned.

BACKGROUND OF THE INVENTION

This invention relates to fluid compositions useful especially for transmitting energy in mechanical systems and, more particularly, to water-based compositions useful in transmitting hydraulic energy having enhanced lubricity and anti-wear properties.

Water-based hydraulic fluids are well known and have been used commercially for a number of years especially in applications where fire resistance is desired. One commonly used class of such water-based fluids, as disclosed, for example, in U.S. Pat. No. 2,602,780 to Zisman et al. and U.S. Pat. No. 2,768,141 to Langer et al., contain water soluble glycols or glycol ethers for low temperature protection and a high molecular weight polymeric thickener such as water soluble poly(alkylene oxide) polymers for viscosity control. Such compositions also contain a variety of additives in "packages" that are added to enhance lubrication, corrosion protection, and other performance characteristics necessary for hydraulic devices and lubricants.

Water-based hydraulic fluids commonly have high nonflammability, good temperature stability, and a relatively low cost, but generally have poorer anti-wear characteristics than petroleum-based fluids. Fluids used in energy transmission systems must possess sufficient lubricity and mechanical stability to enable them to be used in the self-lubricated pumps, valves, etc. employed in commercial hydraulic systems. Good lubricating properties, especially good lubricity and film strength, are particularly important in reducing the wear of moving components of hydraulic systems where the clearance between frictional surfaces may be very small and pressures may be very high.

Heretofore, various attempts have been made to improve the lubricating properties and/or poor anti-wear properties of these fluids including, for example, modifying the poly(alkylene oxide) polymers generally added as viscosity control agents; incorporating additives such as conventional oil improvers, E.P. agents, corrosion inhibitors, and sequestering agents; and incorporating special water soluble additives such as the oxyalkylene adducts of polyamides disclosed in U.S. Pat. No. 3,992,312 to Genjida et al. However, none of these methods have been found to be completely effective, particularly where anti-wear resistance under high pressure conditions is desired, and the development of water-based fluids that would meet these requirements would be highly desirable. Moreover, it would also be desirable to provide energy transmitting fluids that contain more water than the 50 percent to which such known fluids are generally limited in commercial applications.

SUMMARY OF INVENTION

In accordance with the present invention there is provided a water-based energy transmitting and lubricating fluid having enhanced anti-wear properties which comprises an aqueous composition having a viscosity of at least about 10 centistokes at 40° C. which contains up to about 80 percent by weight of water and has incorporated therein at least 0.1 percent by weight of an acidic lubricity agent and an amount of an anti-wear additive which is effective in enhancing the anti-wear characteristics of said composition, said anti-wear additive comprising the combination of a hydroxyl substituted aromatic acid component and a nitroaromatic compound component. Compositions of the invention may also contain from 0 to about 50 percent by weight of a water soluble glycol or glycol ether having 2 to about 14 carbon atoms used as a freezing point depressant and from about 5 to about 50 percent by weight of a water-soluble polymeric viscosity control agent.

Also provided in accordance with the present invention is a method for enhancing the anti-wear properties of water-based energy transmitting fluids containing an acidic lubricity agent which comprises incorporating in said water-based energy transmitting fluid an anti-wear additive comprising the combination of a hydroxyl-substituted aromatic acid component and a nitroaromatic compound component in an amount which is effective in enhancing the anti-wear characteristics of said fluid compositions.

It has been found that the particular combination of anti-wear additive components herein disclosed is efficient in enhancing the anti-wear and lubricity properties of water-based energy transmitting compositions which also contain conventional acidic lubricity agents and makes possible the preparation of such compositions with as much as 80 percent by weight of water, a significantly greater amount of water than may be used in water-based compositions heretofore employed as energy transmission fluids.

DESCRIPTION OF THE INVENTION

In accordance with the present invention, the water-based energy transmitting fluid is an aqueous composition having a viscosity of at least 10 centistokes at 40° C. which contains up to 80 percent by weight of water and a conventional acidic lubricity agent to which has been added an anti-wear and lubricity additive which is the combination of a hydroxyl-substituted aromatic acid component and a nitroaromatic compound component.

The acidic lubricity agents suitable for use in compositions of the invention are well known materials which are conventionally used as lubricity improvers in water-based hydraulic and the like fluids. Such suitable acidic materials include, for example, saturated and unsaturated aliphatic carboxylic and polycarboxylic acids having at least 6 carbon atoms such as caproic acid, caprylic acid, pelargonic acid, capric acid, lauric acid, myristic acid, palmitic acid, stearic acid, oleic acid, linoleic acid, undecanoic acid, oxalic acid, malonic acid, succinic acid, glutaric acid, adipic acid, maleic acid, fumaric acid, glutaconic acid, butenetricarboxylic acid; aromatic carboxylic acids such as benzoic acid, dimethylbenzoic acid, phthalic acid, terephthalic acid, isophthalic acid and trimellitic acid; alkali metal or organic amine salts of said aliphatic and aromated carboxylic acids such as morpholine; polymerized fatty acids (dimer acids); oxycarboxylic acids such as malic and tartaric acid; and lecto-dicarboxylic acids such as acetonedicarboxylic acid.

As a general rule, the acidic lubricity agent may be present in an amount between about 0.1 and 10 percent by weight and are conventionally used in an amount between about 0.5 and 2 percent by weight of the water-based composition, but greater amounts of said agent may be employed if desired for particular applications.

An essential component of the compositions of the invention is an anti-wear additive which is the combination of a hydroxyl-substituted aromatic acid component and a nitroaromatic compound component.

Nitroaromatic compounds which are suitable for use as an anti-wear additive component in compositions of the invention are mononuclear aromatic compounds having at least one substituent nitro group. Such suitable nitroaromatic compounds are the nitro-substituted aromatic acids and compounds such as nitroaromatic salts, esters, and the like, that, in situ, effect the formation of the acid anion. Exemplary suitable nitroaromatic compounds are the nitrobenzoic acids, e.g. 3-nitrobenzoic acid, 3,5-dinitrobenzoic acid, and the like, and alkali metal, amine, or ammonium salts thereof.

Hydroxyl-substituted aromatic acids which are suitable for use in combination with said nitroaromatic compounds are the mononuclear hydroxyl-substituted aromatic acids such as, for example, salicylic acid, and dihydroxy substituted benzoic acid and the bridged dimer of hydroxyl-substituted aromatic carboxylic acids of the general formula:

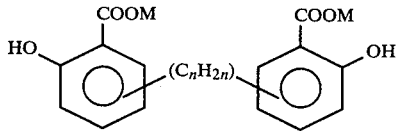

(1)

or

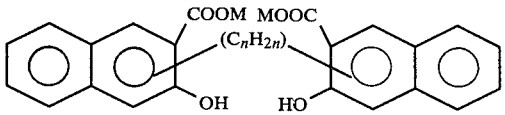

(2)

Wherein M is hydrogen, alkali metal, alkaline earth metal or ammonium and n is an integer having a value from 1 to 4.

Exemplary suitable bridged dimer acids are methylene bridged, hydroxyl-substituted aromatic carboxylic acids such as 5,5'-methylenedisalicylic acid and pamoic acid. The compound may be present in the composition as a salt such as an alkali metal, amine, or ammonium salt.

In compositions of this invention, it is essential that both a nitroaromatic compound and a hydroxyl-substituted acid be present in order to prepare water-based compositions that exhibit enhanced anti-wear and lubricity properties. As a general rule, the combination of anti-wear additive components hereinabove described should be present in a combined amount sufficient to impart the desired degree of anti-wear properties and lubricity to the composition, depending upon the operating conditions and service requirement for a particular application. The amount of the combination of anti-wear additive components that should be present will be called herein "minimally effective amount," which is defined as being the minimum amount required to achieve the anti-wear properties and lubricity required for a particular application. While the amount of each of the anti-wear additive components and the "minimally effective amount" of the combination thereof may vary somewhat depending on the application, the amount of each of the additive components present should be at least about 0.0025 gram-moles per liter (generally about 0.003 weight percent) and preferably from about 0.01 to about 0.50 or even more, gram-moles per liter of aqueous composition (generally between about 0.01 to about 10 percent by weight). The relative proportions of and the maximum amount of each of the additive components and the combination thereof that should be present is not critical, with economic factors generally determining the use of amounts greatly in excess of that actually required.

The water-based compositions of the invention should have a viscosity of at least 10 centistokes at 40° C. and may contain up to about 80 percent by weight of water. In general, the viscosity of the aqueous composition of the invention may vary depending upon the energy transmission application for which it is intended and the temperature range over which it will be used. For example, energy transmitting fluids such as hydraulic fluids may have viscosities in the range of about 25 to 150 centistokes at 40° C., and preferably in the range of about 30 to 85 centistokes, and lubricating fluids may be used with similar viscosity requirements. While it is desirable to be able to provide an energy transmitting fluid which contains the greatest amount of water in order to provide fire resistance characteristics, it is also important that such fluid have a viscosity range that is capable of operating in existing equipment, as well as providing adequate boundary lubrication and lubrication for mechanical components. Accordingly, the water content of the compositions of the invention may vary in the range of from about 20 percent to about 80 percent, and preferably from about 30 percent to about 70 percent by weight.

To achieve the range of viscosities that may be desired for a particular application and wherein the water content of such compositions may be varied over a broad range, a water-soluble polymeric viscosity control and/or thickening agent is generally employed in an amount that ranges from about 5 percent to 50 percent, and preferably from about 10 to 20 percent by weight of the composition. Water-soluble polymers that are suitable for use as viscosity control agents in the compositions of the invention are poly(alkylene oxide) polymers. Such polymers are known compounds which, even though of high molecular weight, are wateer-soluble. In general, these polymers will contain oxyethylene groups or both oxyethylene groups and higher oxyalkylene groups such as oxypropylene and oxybutylene groups either in random or block distribution in their molecules, and will have average molecular weights from 400 to about 40,000, or even higher. The amount of oxyethylene groups in the molecule is such that the poly(alkylene oxide) polymers are soluble in water at ordinary temperatures, and the amount of oxypropylene or higher oxyalkylene groups is such that the poly(alkylene oxide) remains liquid at ordinary temperatures up to an average molecular weight of 40,000 and higher or may melt at temperatures below about 60° C. The oxypropylene/oxyethylene ratio may vary from zero to about unity. These poly(alkylene oxide) polymers may be made by processes well known in the art by reacting ethylene oxides or mixtures of ethylene oxide and propylene oxide or higher alkylene oxide with a compound having at least one active hydrogen atom up to as many as six such active hydrogen atoms including, for example, water, monohydroxylic alcohols such as ethanol and propanol, dihydroxylic alcohols such as ethylene glycol, trihydroxylic alcohols such as glycerine and trimethylopropane, tetrahydroxylic alcohols such as pentaerythritol, hexahydroxylic alcohols such as sorbitol, and mono- or poly-functional amines such as butylamine and ethylene diamine. The poly(alkylene oxide) products of such reaction will have linear or branched oxyethylene or oxyethylene-higher oxyalkylene chains and such chains will terminate with hydroxyl groups. Some or all of these hydroxyl groups may be etherified by reaction with a dialkyl sulfate such as diethyl sulfate.

Another known class of water-soluble polymers that are suitable as thickeners or viscosity control agents are the polymer adducts of alkyl phenols and alkylene oxides such as, for example, the ethylene oxide/propylene oxide adducts of alkyl phenol disclosed in U.S. Pat. No. 2,768,141 to Langer et al. and the ethoxylated dinonyl phenol disclosed in U.S. Pat. No. 3,379,644 to Katzenstein.

Also suitable as viscosity control agents are the water-soluble polyalkyl methacrylates disclosed, for example, in U.S. Pat. No. 3,352,783 to McCord which generally results from the polymerization of alkyl methacrylates in which the alkyl groups can have an average of from about 3 to 10 carbon atoms. The urethane polymers such as disclosed in U.S. Pat. No. 3,352,783 are other suitable water-soluble polymers for use as a viscosity control agent.

Other suitable water-soluble polymers are, for example, polyamide esters such as disclosed in U.S. Pat. No. 3,341,573 to Shibe and polyamide alkoxylates such as disclosed in U.S. Pat. No. 3,992,312 to Genjida et al.

In accordance with the present invention, preferred embodiments of the compositions of the invention may also contain a water-soluble freezing point depressant. The water-soluble freezing point depressants conventionally employed are glycols or glycol ethers having 2 to about 14 carbon atoms such as ethylene glycol, diethylene glycol, triethylene glycol, ethylene glycol ethers such as the ethyl, methyl, propyl and butyl ethers thereof, and similar ethers of diethylene and triethylene glycol. In general, it is preferred to use the simpler polyols as represented by ethylene glycol, propylene glycol, butylene glycol, glycerine, and diethylene glycol. As the basis of the energy transmitting fluid of the invention, it is preferable to use proportions of said glycols or glycol ethers which will give, in combination with water, the low temperature serviceability desired.

The energy transmission fluids of this invention may also contain other components conventionally used in water-based fluids such as corrosion, oxidation, and foam inhibitors, pH conditioners, dyes, sequestering agents and the like which may be used in small amounts from about 0.01 to about 5 to 10 percent by weight of the composition. Exemplary of such materials that may be used are corrosion inhibitors including monoethanolamine, monoisopropanolamine, diethanolamine, triethanolamine, ethylenediamine, dimethylethanolamine, diethylenetriamine, cyclohexylamine, morpholine, 1,4-bis (2-aminoethyl)pyperadine, 2-heptadecyl-1-(2-hydroxyethyl)imidazoline, derivatives thereof such as alkaline oxide adducts, alkali metal salts of carboxylic acids and the like; pH conditioners including organic amines as mentioned as corrosion inhibitors and alkali metal hydroxides; antioxidants including benzotriazole, mercaptobenzoimidazole, and mercaptobenzothiazole; foam inhibitors including silicones of the emulsion type; dyes including basic dyes and acid dyes; and sequestering agents such as aminocarboxylic acids and derivates thereof including ethylenediaminetetraacetic acid (EDTA), diethylenetriaminepentaacetic acid, sodium or copper salts thereof, and oxycarboxylic acids and derivates thereof such as tartaric acid and sodium gluconate.

In preparing the water-based compositions of the invention, each of the components used may be added in any order of addition, or combinations of some of them may be prepared prior to incorporating in the composition. In general, each of the components to be used should be water-soluble or previously made into a water-soluble form such as the alkali metal or ammonium salts thereof, or should be capable of being solubilized in situ.

In accordance with the present invention, there is also provided a method whereby the anti-wear and lubricity characteristics of a water-based energy transmission fluid may be enhanced by adding to an aqueous composition having a viscosity of at least 10 centistokes at 40° C. which contains up to about 80 percent by weight of water and has incorporated therein an acidic lubricity agent as hereinabove described, an anti-wear additive which comprises the combination of nitroaromatic compound component and a hydroxyl substituted aromatic acid in an "effective amount" to enhance the anti-wear and lubricity properties thereof. Such additive components may be in the alkali metal or ammonium salt solubilized form thereof or in a form that is solubilized in situ.

In an alternate embodiment, in the event that the water-based fluid composition to be treated does not contain an acidic lubricity agent as herein described, such component may be added to the fluid when the anti-wear additive components are added.

The invention will become more clear when considered together with the following examples, which are set forth as being merely illustrative of the invention and which are not intended, in any manner, to be limitative thereof. Unless otherwise indicated, all parts and percentages are by weight.

EXAMPLES

Measurement of the wear and lubricating properties of the water-based energy transmitting compositions of this invention, as well as the compositions used for comparison purposes are performed on a hydraulic fluid test stand as described in ASTM D-2882-74 "Vane Pump Testing of Petroleum Hydraulic Fluids". The operational conditions for the tests are as follows:

| | |
|---|---|
| Pump | Vickers V-104-C-10 (8 gpm) Vane Pumps |
| Pump Speed | 1200 rpm |
| Pump Pressure | 123 kg/cm$^2$ (1750 psig)<br>134 kg/cm$^2$ (1900 psig)<br>141 kg/cm$^2$ (2000 psig) |
| Fluid Temperature | 66° C. |
| Fluid Quantity | 5000 ml |

The apparatus and procedure described above are used to evaluate the wear of metal pump cam ring and vanes using various water-based compositions of this invention in comparison with a composition prepared without the anti-wear additive of the invention. The proportion of ingredients used in preparing the compositions evaluated in this Example are summarized in the following tables.

The polymeric thickener used in the compositions of this Example is a water-soluble product available under the trademark designation UCON 75-H-380,000 from Union Carbide Corporation. The copper corrosion inhibitor is available commercially under the trademark designation REOMET 41 from Ciba-Geigy Corp.

COMPARATIVE EXAMPLES 1-7

The following are comparative examples, conducted in accordance with the above-described procedure that describe the performance of the energy transmitting fluid compositions specified in Table I.

TABLE I

| Ingredients, Wt. % | Example 1 | 2 | 3 | 4 | 5 | 6 | 7 |
|---|---|---|---|---|---|---|---|
| Water, Deionized | 40 | 40 | 40 | 40 | 40 | 40 | 40 |
| Ethylene Glycol | 43.5 | 43.5 | 43.5 | 43.5 | 43.5 | 43.5 | 43.5 |
| 75-H-380,000 | 14.1 | 14.1 | 14.1 | 14.1 | 14.1 | 14.1 | 14.1 |
| Capric Acid | 0.86 | 0.86 | 0.86 | 0.86 | 0.86 | 0.86 | 0.86 |
| Dimethylethanolamine | 0.99 | 0.99 | 0.99 | 0.99 | 0.99 | 0.99 | 0.99 |
| Monoisopropanolamine | 0.49 | 0.49 | 0.49 | 0.49 | 0.49 | 0.49 | 0.49 |
| Reomet 41 | 0.06 | 0.06 | 0.06 | 0.06 | 0.06 | 0.06 | 0.06 |
| Methylenedisalicylic Acid | 0.03 | — | — | — | — | — | — |
| 3,5 Dinitrobenzoic Acid | — | 0.4 | — | — | — | — | — |
| Para-Nitrobenzoic Acid | — | — | 0.34 | — | — | — | — |
| Meta-Nitrobenzoic Acid | — | — | — | 0.34 | — | — | — |
| 2,4 Dihydroxybenzoic Acid | — | — | — | — | 0.16 | — | — |
| Salicylic Acid | — | — | — | — | — | 0.14 | — |
| Disodium Pamoate | — | — | — | — | — | — | 0.4 |
| Pump Test Data | Wear Mg/100 hours weight loss of pump cam ring and vanes. | | | | | | |
| Pump Discharge Pressure, 2000 psig | 3300 | 5000+ | 4500 | 4100 | 5000 | 5200 | 5000 |

The above table demonstrates that the test pump parts exhibit considerable wear when only one of the claimed components of the claimed inhibitive mixture is present in the composition.

EXAMPLES 8-13

The following examples illustrate the effectiveness of the claimed combination of inibitors in tests run as in Comparative Examples 1-7 with the changes in the compositions set forth in Table III.

TABLE II

| Ingredients, Wt. % | Composition 8 | 9 | 10 | 11 | 12 | 13 |
|---|---|---|---|---|---|---|
| Deionized Water | 40 | 40 | 44 | 44 | 40 | 40 |
| Ethylene Glycol | 44 | 44 | 40 | 40 | 44 | 44 |
| Polymeric Thickener | 13.15 | 12.99 | 13.12 | 13.04 | 13.07 | 14.65 |
| Capric Acid | 1.0 | 1.0 | — | — | 1.0 | 1.0 |
| Lauric Acid | — | — | — | 1.0 | — | — |
| Pelargonic Acid | — | — | 1.0 | — | — | — |
| Benzoic Acid | — | 0.01 | 0.01 | 0.01 | 0.01 | 0.01 |
| Dimethylethanolamine | 1.0 | 1.0 | 1.0 | 1.0 | 1.0 | — |
| Monoisopropanolamine | 0.5 | 0.5 | 0.5 | 0.5 | 0.5 | — |
| Reomet 41 | 0.1 | 0.1 | 0.1 | 0.1 | 0.1 | 0.1 |
| 3,5-Dinitrobenzoic Acid | — | 0.2 | 0.2 | 0.2 | — | 0.2 |
| m-Nitrobenzoic Acid | — | — | — | — | 0.17 | — |
| p-Nitrobenzoic Acid | 0.1 | — | — | — | — | — |
| Salicylic Acid | — | — | 0.07 | — | — | — |
| 2,4-Dihydroxybenzoic Acid | — | — | — | — | — | 0.8 |
| Methylendisalicylic Acid | 0.15 | — | — | 0.15 | 0.15 | — |
| Disodium Pamoate | — | 0.2 | — | — | — | — |
| Pump Test Wear (Mg/100 hours) | | | | | | |
| Pressure 1750 psig | 20 | — | — | 1700 | 32 | 75 |
| 1900/2000 psig | — | 280 | 145 | — | — | — |

The above table demonstrates the synergistic effectiveness of the claimed combination of wear inhibitors, i.e., the two inhibiting components exhibit an inhibiting effect that is remarkably more than additive in nature.

EXAMPLES 14-17

Using the apparatus and procedure described for Examples 1-13, the lubricity (anti-wear) properties of a series of fluid compositions containing various amounts of water were evaluated. The proportion of ingredients in each of the compositions and wear data obtained with each of the compositions are summarized in Table III.

TABLE III

| | Composition (Wt. %) 14 | 15 | 16 | 17 |
|---|---|---|---|---|
| Deionized Water | 60 | 70 | 75 | 75 |
| Ethylene Glycol | 20 | 9 | 1 | 2.5 |
| Polymeric Thickener | 16.9 | 18.3 | 20.2 | 19.8 |
| Capric Acid | 1.0 | 1.0 | 1.3 | 1.0 |
| DMEA | 1.0 | 1.0 | 1.0 | 1.0 |
| MIPOLA | 0.5 | 0.5 | 0.6 | 0.5 |
| Reomet 41 | 0.1 | 0.1 | 0.1 | 0.1 |
| Benzoic Acid | 0.01 | 0.01 | — | — |
| 3,5-Dinitrobenzoic Acid | 0.1 | 0.1 | 0.5 | 0.1 |
| (DNBA-gram-moles/liter) | (0.005) | (0.005) | (0.025) | (0.005) |
| Salicylic Acid | 0.035 | 0.035 | — | 0.035 |
| (gram-moles/liter) | (0.005) | (0.005) | — | (0.005) |
| 5,5' Methylenedi-salicylic | — | — | 0.3 | — |
| Pump Test Data (Wear-Mg/100 hours) Discharge Pressure | | | | |
| 1000 psig | — | — | 50 | — |
| 1750 psig | 61 | 300 | 3000+ | 3950 |
| 2000 psig | 89 | — | — | — |

The above table demonstrates that 80% by weight is a practical limit to the water content of the energy-transmitting fluids of the claimed invention. Although the values of Examples 16 and 17 do not appear "synergistic" when compared with the values of the earlier examples, 1-13, when the water content is near 80%, the failure to include the combination of inhibitors will lead to total pump failure evidenced by shearing of the metal pump parts if the pump is operated for only a short while. Therefore, while the 80% water energy transmitting fluids are not as desirable for practical purposes, it is believed that the addition of the combination of inhibitors will prevent total pump failure at water concentrations of about 80%.

I claim:

1. A water-based energy transmitting fluid having enhanced anti-wear properties which comprises an aqueous composition having a viscosity of at least 10 centistokes at 40° C. which contains up to about 80 percent by weight of water, at least 0.1 percent by weight of a carboxylic acid lubricity agent and a minimally effective amount of an anti-wear additive which comprises the combination of a hydroxyl-substituted aromatic carboxylic acid component and a nitroaromatic compound component.

2. The water-based fluid of claim 1 which contains at least about 20 percent by weight of water.

3. The water-based fluid of claim 1 wherein said anti-wear additive comprises the combination of at least 0.0025 gram-moles/liter of said hydroxyl-substituted aromatic carboxylic acid component and at least 0.0025 gram-moles/liter of said nitroaromatic compound component.

4. The water-based fluid of claim 1 wherein said nitroaromatic compound component is a nitro substituted mononuclear aromatic acid.

5. The water-based fluid of claim 1 wherein said hydroxyl-substituted aromatic carboxylic acid component is a mononuclear hydroxyl-substituted aromatic carboxylic acid or a bridged dimer of a hydroxyl-substituted aromatic carboxylic acid.

6. The water-based fluid of claim 1 wherein said carboxylic acid lubricity agent is a member selected from the group consisting of saturated and unsaturated aliphatic carboxylic and polycarboxylic acids having at least 6 carbon atoms, aromatic carboxylic acids and alkali metal or organic amine salts of said aliphatic and aromatic acids.

7. The water-based fluid of claim 1 wherein said aqueous composition additionally contains up to about 50 percent by weight of a glycol or glycol ether having 2 to about 14 carbon atoms.

8. The water-based fluid of claim 1 wherein said aqueous composition additonally contains a water-soluble polymeric viscosity control agent in an amount from about 5 percent to 50 percent by weight.

9. The water-based fluid of claim 1 wherein the hydroxyl-substituted aromatic carboxylic acid component is 5,5'-methylenedisalicylic acid.

10. The water-based fluid of claim 1 wherein the hydroxyl-substituted aromatic carboxylic acid component is salicylic acid.

11. The water-based fluid of claim 1 wherein the hydroxyl-substituted aromatic carboxylic acid component is 2,4-dihydroxbenzoic acid.

12. The water-based fluid of claim 1 wherein the hydroxyl-substituted aromatic carboxylic acid component is 2,4-dihydroxybenzoic acid.

13. The water-based fluid of claim 1 wherein the nitroaromatic compound component is m-nitrobenzoic acid.

14. The water-based fluid of claim 1 wherein the nitroaromatic compound component is p-nitrobenzoic acid.

15. The water-based fluid of claim 1 wherein the nitroaromatic compound component is o-nitrobenzoic acid.

16. The water-based fluid of claim 1 wherein the nitroaromatic compound component is a dinitrobenzoic acid.

17. The water-based fluid of claim 1 wherein the nitroaromatic compound component is 3,5 dinitrobenzoic acid.

18. The water-based fluid of claim 1 wherein the hydroxyl-substituted aromatic carboxylic acid component is 5,5'-methylene disalicylic acid and the nitroaromatic compound component is p-nitrobenzoic acid.

19. The method of enhancing the anti-wear and lubricity properties of a water-based energy transmitting fluid containing a carboxylic acid lubricity agent which comprises incorporating in said water-based fluid a minimally effective amount of an anti-wear additive comprising the combination of a hydroxyl substituted aromatic carboxylic acid component and a nitroaromatic compound component.

20. A water-based energy transmitting fluid having enhanced anti-wear properties which comprises an aqueous composition having a viscosity of at least 10 centistokes at 40° C. which contains up to about 80 percent by weight of water, at least 0.1 percent by weight of an acidic lubricity agent and an effective amount of an anti-wear additive which comprises the combination of a hydroxyl substituted aromatic acid component and a nitroaromatic compound component.

* * * * *